US011512479B2

(12) United States Patent
Devos

(10) Patent No.: US 11,512,479 B2
(45) **Date of Patent: *Nov. 29, 2022**

(54) FLOOR PANEL FOR FORMING A FLOOR COVERING

(71) Applicant: FLOORING INDUSTRIES LIMITED, SARL, Bertrange (LU)

(72) Inventor: Pieter Devos, Koolskamp (BE)

(73) Assignee: FLOORING INDUSTRIES LIMITED, SARL, Bertrange (LU)

( * ) Notice: Subject to any disclaimer, the term of this patent is extended or adjusted under 35 U.S.C. 154(b) by 0 days.

This patent is subject to a terminal disclaimer.

(21) Appl. No.: 16/952,421

(22) Filed: Nov. 19, 2020

(65) Prior Publication Data

US 2021/0071429 A1 Mar. 11, 2021

Related U.S. Application Data

(63) Continuation of application No. 16/413,986, filed on May 16, 2019, now Pat. No. 10,889,997, which is a (Continued)

(30) Foreign Application Priority Data

Mar. 17, 2015 (BE) ..... 2015/5158

(51) Int. Cl.
*E04F 15/02* (2006.01)

(52) U.S. Cl.
CPC *E04F 15/02038* (2013.01); *E04F 2201/0138* (2013.01); *E04F 2201/0146* (2013.01); (Continued)

(58) Field of Classification Search
CPC ..... E04F 15/02; E04F 15/02038; E04F 15/10; E04F 15/105; E04F 2201/03; (Continued)

(56) References Cited

U.S. PATENT DOCUMENTS 6,505,452 B1 1/2003 Hannig et al.
7,896,571 B1 3/2011 Hannig et al.
(Continued)

FOREIGN PATENT DOCUMENTS

CA 2866109 A1 * 9/2012 ..... E04F 15/10
DE 20002744 U1 8/2000
(Continued)

OTHER PUBLICATIONS

Belgium Search Report from BE Application No. 201505158, dated May 11, 2016.
(Continued)

*Primary Examiner* — Jessie T Fonseca
(74) *Attorney, Agent, or Firm* — Workman Nydegger

(57) ABSTRACT

A floor panel for forming a floor covering, wherein this floor panel is at least composed of a substrate; wherein the floor panel, on at least one pair of opposite edges, comprises coupling parts, which coupling parts allow that two of such floor panels can be coupled to each other by means of a downward movement of one floor panel in respect to the other floor panel; wherein these coupling parts, in the coupled condition of two of such floor panels, form a first locking system, which effects a locking in a first direction perpendicular to the plane of the floor panels, and form a second locking system, which effects a locking in a second direction perpendicular to the edges and in the plane of the floor panels.

8 Claims, 10 Drawing Sheets

Related U.S. Application Data continuation of application No. 15/543,908, filed as application No. PCT/IB2016/050137 on Jan. 13, 2016, now Pat. No. 10,309,113.

(60) Provisional application No. 62/104,108, filed on Jan. 16, 2015.

(52) U.S. Cl.
CPC ..... *E04F 2201/0153* (2013.01); *E04F 2201/0169* (2013.01); *E04F 2201/023* (2013.01); *E04F 2201/03* (2013.01); *E04F 2201/041* (2013.01)

(58) Field of Classification Search
CPC ..... E04F 2201/04; E04F 2201/045; E04F 2201/048; E04F 2201/049; E04F 2201/021; E04F 2201/023; E04F 2201/0123; E04F 2201/013; E04F 2201/0138; E04F 2201/0146; E04F 2201/0153; E04F 2201/0169; E04F 2201/041
See application file for complete search history.

(56) References Cited

U.S. PATENT DOCUMENTS

| | | | | |
|---|---|---|---|---|
| 8,038,363 | B2 * | 10/2011 | Hannig | B27F 1/04 403/339 |
| 8,191,334 | B2 * | 6/2012 | Braun | E04F 15/02 52/747.11 |
| 8,365,499 | B2 * | 2/2013 | Nilsson | E04F 15/02038 52/747.1 |
| 8,375,672 | B2 | 2/2013 | Hannig | |
| 8,726,604 | B2 * | 5/2014 | Hannig | E04F 15/10 52/592.1 |
| 9,650,792 | B2 | 5/2017 | Ramachandra | |
| 9,670,682 | B2 * | 6/2017 | Cappelle | E04F 15/02194 |
| 9,670,683 | B2 | 6/2017 | Cappelle | |
| 9,695,851 | B2 | 7/2017 | Hannig | |
| 10,190,611 | B2 | 1/2019 | Hannig | |
| 2003/0145549 | A1 | 8/2003 | Palsson et al. | |
| 2004/0128934 | A1 | 7/2004 | Hecht | |
| 2004/0211143 | A1 | 10/2004 | Hanning | |
| 2004/0250492 | A1 | 12/2004 | Becker | |
| 2007/0130872 | A1 | 6/2007 | Goodwin et al. | |
| 2008/0241440 | A1 | 10/2008 | Bauer | |
| 2008/0245020 | A1 | 10/2008 | Kiefel et al. | |
| 2009/0049787 | A1 | 2/2009 | Hannig | |
| 2009/0133353 | A1 | 5/2009 | Pervan et al. | |
| 2010/0031594 | A1 | 2/2010 | Liu et al. | |
| 2010/0037550 | A1 | 2/2010 | Braun | |
| 2010/0293879 | A1 | 11/2010 | Pervan et al. | |
| 2010/0300029 | A1 | 12/2010 | Braun et al. | |
| 2011/0131909 | A1 | 6/2011 | Hannig | |
| 2011/0138722 | A1 | 6/2011 | Hannig | |
| 2012/0096801 | A1 | 4/2012 | Cappelle | |
| 2012/0180416 | A1 * | 7/2012 | Perra | E04C 2/40 52/309.1 |
| 2012/0266555 | A1 | 10/2012 | Cappelle | |
| 2013/0036695 | A1 | 2/2013 | Durnberger | |
| 2013/0042558 | A1 | 2/2013 | Cordeiro | |
| 2013/0097959 | A1 | 4/2013 | Michel | |
| 2013/0104486 | A1 | 5/2013 | Windmöller | |
| 2013/0212971 | A1 | 8/2013 | Cordeiro | |
| 2013/0276398 | A1 | 10/2013 | Hannig | |
| 2013/0309441 | A1 | 11/2013 | Hannig | |
| 2014/0007539 | A1 | 1/2014 | Pervan et al. | |
| 2014/0033633 | A1 | 2/2014 | Kell | |
| 2014/0215946 | A1 | 8/2014 | Roy et al. | |
| 2015/0240500 | A1 | 8/2015 | Stevens, Jr. | |
| 2015/0337540 | A1 * | 11/2015 | Cappelle | B32B 3/06 52/309.1 |
| 2016/0138274 | A1 * | 5/2016 | Anspach | E04C 2/30 52/177 |
| 2017/0067261 | A1 * | 3/2017 | Hannig | E04F 15/105 |
| 2017/0175401 | A1 * | 6/2017 | Kell | E04F 13/0894 |
| 2017/0268545 | A1 | 9/2017 | Hannig | |

FOREIGN PATENT DOCUMENTS

| | | | |
|---|---|---|---|
| DE | 19933343 | A1 | 2/2001 |
| EP | 1279778 | A2 | 1/2003 |
| WO | 0102669 | A1 | 1/2001 |
| WO | 0175247 | A1 | 10/2001 |
| WO | 2004059104 | A1 | 7/2004 |
| WO | 2006133690 | A1 | 12/2006 |
| WO | 2011077311 | A2 | 6/2011 |
| WO | 2012101171 | A1 | 8/2012 |
| WO | 2014182215 | A1 | 11/2014 |
| WO | 2016105266 | A1 | 6/2016 |

OTHER PUBLICATIONS

International Search Report from PCT Application No. PCT/IB2016/050137, dated May 24, 2016.
Office Action from European Application No. EP16712451.0, dated Aug. 16, 2021.

* cited by examiner

FLOOR PANEL FOR FORMING A FLOOR COVERING

CROSS-REFERENCE TO RELATED APPLICATIONS

This application is a continuation of the U.S. application Ser. No. 16/413,986 filed May 16, 2019, which is a continuation of U.S. application Ser. No. 15/543,908 filed on Jul. 14, 2017, now U.S. Pat. No. 10,309,113, which claims the benefit under 35 U.S.C. 119(e) to the U.S. provisional application No. 62/104,108 filed on Jan. 16, 2015, each of which is incorporated herein by reference.

BACKGROUND OF THE INVENTION

1. Field of the Invention

This invention relates to a floor panel for forming a floor covering, more particularly for forming a floor covering which can be installed on an underlying surface.

More particularly, it relates to floor panels which can be coupled to each other by means of mechanical coupling parts.

2. Related Art

Still more particularly, the invention relates to a floor panel for forming a floor covering, of the type wherein this floor panel is at least composed of a substrate; wherein the floor panel comprises coupling parts on at least one pair of opposite edges, which coupling parts allow that two of such floor panels can be coupled to each other by means of a downward movement of one floor panel in respect to the other floor panel; wherein the coupling parts, in the coupled condition of two of such floor panels, form a first locking system which effects a locking in a first direction in the plane of the floor panels, as well as form a second locking system which effects a locking in a second direction perpendicular to the edges and in the plane of the floor panels; wherein said coupling parts substantially are formed of the material of said substrate and are realized in one piece therewith; wherein the second locking system is formed at least of a downward-directed upper hook-shaped part which is situated on the one edge of said pair of opposite edges, as well as an upward-directed lower hook-shaped part which is situated on the other, opposite edge of said pair of opposite edges, which hook-shaped parts can be engaged behind each other by means of said downward movement; wherein said upper hook-shaped part consists of a lip with a downward-directed locking element, whereas said lower hook-shaped part consists of a lip with an upward-directed locking element; and wherein said first locking system comprises locking parts in the form of one or more protrusions, which, in the coupled condition of two of such floor panels, respectively cooperate with one or more undercuts, which one or more protrusions are situated in the proximity of the distal extremity of the upper hook-shaped part and which one or more undercuts are situated in the proximity of the proximal extremity of the lower hook-shaped part.

Such floor panels are known, amongst others, from the patent documents DE 19933343, DE 20002744, EP 1.279.778, WO 2006/133690, WO 2011/077311, WO 2012/101171. Each of these floor panels, however, is subject to certain disadvantages in respect to the installation of the floor covering and/or the strength of the floor covering, or in other words the strength of the coupling between the floor panels themselves.

SUMMARY OF THE DISCLOSURE

The present invention primarily aims at an alternative floor panel for forming a floor covering, of the aforementioned type, wherein according to various preferred embodiments solutions are offered for problems with floor panels of the state of the art.

The inventor has found that the ease of installation of the floor covering and the strength in the floor covering strongly depends on the characteristics of the coupling parts, and in particular on the support and contact surfaces, as well as on the location and the form of the locking parts which provide for a vertical locking. The inventor has found that certain combinations of characteristics of the coupling parts render particularly good results, in particular with synthetic floor panels, however, also with floor panels which are composed of other materials.

These specific combinations of characteristics of the coupling parts are described herein after in three independent aspects of the present invention.

According to a first independent aspect thereof, the present invention relates to a floor panel for forming a floor covering, of the aforementioned type, with the characteristic that said lip of the upper hook-shaped part is provided with a support surface with which this upper hook-shaped part, in the coupled condition of two of such floor panels, rests on the lip of the lower hook-shaped part; that said lip of the upper hook-shaped part is provided with an upward-directed recess in which said upward-directed locking element, in the coupled condition of two of such floor panels, is situated at least partially; that said support surface is situated closer to the distal extremity of the upper hook-shaped part than said downward-directed locking element, which in its turn is situated closer to said distal extremity than said upward-directed recess; that the most upward-situated point of the upward-directed recess is situated higher than said support surface, which in its turn is situated higher than the most downward-situated point of said downward-directed locking element; and that the distal extremity of at least one of said protrusions is situated farther distal than a vertical closing surface which is formed between two of such floor panels in the coupled condition.

As the distal extremity of at least one of the protrusions is situated farther distal than the vertical closing surface, a good vertical locking can be effected, which promotes the general locking strength. This locking strength can be improved even more by the mutual positions of the respective locking element and the respective recess in respect to the support surface. These mutual positions in fact offer the possibility of realizing rather strong and stable locking surfaces. Moreover, the respective mutual positions provide for that the ease of installation also can be guaranteed in that they can offer the required elasticity to the hook-shaped parts and here in particular the upper hook-shaped part.

The locking strength can still be improved in the case that the distance between an upper side of the floor panel and the most downward-situated point of said downward-directed locking element is at least 1.1 times larger than the distance between the upper side of the floor panel and the most downward-situated point of said support surface, and more preferably at least 1.15 times larger.

The mentioned advantages will be more pronounced when the distance between an upper side of the floor panel and the most downward-situated point of said support surface preferably is at least 1.2 times larger than the distance between the upper side of the floor panel and the most upward-situated point of said upward-directed recess and preferably even is at least 1.3 times larger.

Preferably, the distance between an upper side of the floor panel and the most upward-situated point of said upward-directed recess even preferably is less than half of the overall thickness of the floor panel. So, the upper hook-shaped part can be provided with the required deformability or elasticity, which is beneficial to the smoothness of installation.

Preferably, the proximal extremity of the upper hook-shaped part and/or the distal extremity of the lower hook-shaped part is free from locking parts.

Said support surface may be situated substantially horizontal.

Preferably, the upper hook-shaped part comprises one or more guiding surfaces, which respectively extend downward in an inclined manner starting from the one or more protrusions. These guiding surfaces preferably extend downward in an inclined manner at an angle of at least 10 degrees with a vertical, and more preferably at an angle of at least 15 degrees with the vertical. The guiding surfaces provide for that, with a possible faulty mutual placement of the edges during coupling they still can be guided to a locking position.

It is also noted that the guiding surface do not necessarily have to be flat, however, can be curved or bent.

According to an independent second aspect thereof, the present invention relates to a floor panel for forming a floor covering, of the aforementioned type, with the characteristic that said lip of the lower hook-shaped part is provided with a support surface on which the lip of the upper hook-shaped part rests in the coupled condition of two of such floor panels; that said lip of the lower hook-shaped part is provided with a downward-directed recess in which said downward-directed locking element, in the coupled condition of two of such floor panels, is situated at least partially; that said support surface is situated closer to the proximal extremity of the lower hook-shaped part than said downward-directed recess, which in its turn is situated closer to the proximal extremity of the lower hook-shaped part than said upward-directed locking element; that the most upward-situated point of the upward-directed locking element is situated higher than said support surface, which in its turn is situated higher than the most downward-situated point of said downward-directed recess; that the upper hook-shaped part comprises one or more guiding surfaces, which respectively extend downward in an inclined manner, starting from the one or more protrusions; that the distal extremity of the lower hook-shaped part is free from locking parts; and that the distal extremity of at least one of said protrusions is situated farther distal than an vertical closing surface which is formed between two of such floor panels in the coupled condition.

As the distal extremity of at least one of the protrusions is situated farther distal than the vertical closing surface, a good vertical locking can be effected, which promotes the general locking strength. This locking strength can still be improved by the mutual positons of the respective locking element and the respective recess in respect to the support surface. These mutual positions in fact offer the possibility of realizing rather strong and stable locking surfaces. Moreover, the respective mutual positions, together with the guiding surfaces and the free distal extremity of the lower hook-shaped part, provide for that the ease of installation still can be guaranteed. In particular, the mutual positions and the being free of the distal extremity of the lower hook-shaped part offer the possibility of an extremely simple deformation or bending out of the lower hook-shaped part, as a result of which the floor panels can be installed in a very smooth manner.

Preferably, the proximal extremity of the upper hook-shaped part is free from locking parts.

The mentioned advantages will be still more pronounced when the distance between a lower side of the floor panel and the most downward-situated point of said support surface is at least 1.2 times larger than the distance between the lower side of the floor panel and the most downward-situated point of said downward-directed recess and preferably is at least 1.3 times larger and still more preferably is at least 1.35 times larger.

The locking strength can still be improved in the case that the distance between a lower side of the floor panel and the most downward-situated point of said upward-directed locking element is at least 1.1 times larger than the distance between the lower side of the floor panel and the most downward-situated point of said support surface and more preferably is at least 1.2 times larger and still more preferably is at least 1.25 times larger.

Preferably, the distance between a lower side of the floor panel and the most upward-situated point of said upward-directed locking element even is more than half of the overall thickness of the floor panel.

The mentioned support surface can be situated substantially horizontal.

The guiding surfaces preferably extend downward in an inclined manner at an angle of at least 10 degrees with the vertical and more preferably at an angle of at least 15 degrees with the vertical.

According to an independent third aspect thereof, the present invention relates to a floor panel for forming a floor covering, of the aforementioned type, with the characteristic that said lip of the lower hook-shaped part is provided with a support surface on which the lip of the upper hook-shaped part, in the coupled condition of two of such floor panels, is resting; that said lip of the lower hook-shaped part is provided with a downward-directed recess, in which said downward-directed locking element, in the coupled condition of two of such floor panels, is situated at least partially; that said support surface is situated closer to the proximal extremity of the lower hook-shaped part than said downward-directed recess, which in its turn is situated closer to the proximal extremity of the lower hook-shaped part than said upward-directed locking element; that the most upward-situated point of the upward-directed locking element is situated higher than said support surface, which in its turn is situated higher than the most downward-situated point of said downward-directed recess; that the distal extremity of at least one of said protrusions is situated farther distal than a vertical closing surface, which is formed between two of such floor panels in the coupled condition; and that the distance between a lower side of the floor panel and the most downward-situated point of said support surface is at least 1.2 times larger than the distance between the lower side of the floor panel and the most downward-situated point of said downward-directed recess, and preferably is at least 1.3 times larger and still more preferably is at least 1.35 times larger.

As the distal extremity of at least one of the protrusions is situated farther distal than the vertical closing surface, a good vertical locking can be effected, which promotes the general locking strength. This locking strength can still be improved by the mutual positions of the respective locking element and the respective recess in respect to the support surface. These mutual positions in fact offer the possibility of realizing rather strong and stable locking surfaces. Moreover, the mutual positions provide for that the ease of installation still can be guaranteed.

The locking strength can still be improved in the case that the distance between a lower side of the floor panel and the most upward-situated point of said upward-directed locking element is at least 1.1 times larger than the distance between the lower side of the floor panel and the most downward-situated point of said support surface and preferably is at least 1.2 times larger and still more preferably is at least 1.25 times larger.

Preferably, the distance between a lower side of the floor panel and the most upward-situated point of said upward-directed locking element even is more than half of the overall thickness of the floor panel.

Preferably, the distal extremity of the lower hook-shaped part and/or the proximal extremity of the upper hook-shaped part is free from locking parts.

The mentioned support surface can be situated substantially horizontal.

The upper hook-shaped part preferably comprises one or more guiding surfaces, which respectively extend downward in an inclined manner, starting from the one or more protrusions. Such guiding surfaces may facilitate the installation of the floor panels even more. In particular, the guiding surfaces extend downward in an inclined manner at an angle of at least 10 degrees with a vertical and preferably at an angle of at least 15 degrees with the vertical.

It is also noted that any one of the characteristics of any of the three independent aspects of the present invention can be combined at choice with any characteristic of another of the three independent aspects; in as far as such combination is not contradictory.

Further preferred and alternative embodiments of the present invention according to the three independent aspects thereof are described herein below.

In a preferred embodiment, the lip of the lower hook-shaped part comprises an incision on a lower side of this lip, which incision extends in horizontal direction, starting from a distal side of the upward-directed locking element and at least up to there, where the upward-directed and downward-directed locking elements cooperate. Such incision may facilitate the installation of the floor panels even more in that the respective lip is given the opportunity of a simple elastic bending out during the coupling process.

The downward-directed locking element can be provided with a locking surface, which, in the coupled condition of two of such floor panels, cooperates with an adapted thereto locking surface of the upward-directed locking element of the lower hook-shaped part, wherein these locking surfaces, there, where they cooperate, define a tangent line which is situated vertical or does not deviate more than 45 degrees from the vertical. Hereby, the horizontal locking can be realized in a strong manner, which promotes the overall strength of the coupling.

Preferably, one or more spaces are provided between the coupling parts of such floor panels in their coupled condition. Herein below, an overview follows of the spaces, which can be present separately or in combination in the coupled condition:

in the coupled condition of two of such floor panels, a space can be present in the entire intermediary space between a distal side of the upward-directed locking element of the one floor panel and the edge of the other floor panel. This space preferably extends up to below the lip of the upper hook-shaped part. The space described herein provides for that space can be created for a possible elastic bending out of the respective lip when performing the coupling movement, which is beneficial to the ease of installation.

in the coupled condition of two of such floor panels, a space can be present underneath the downward-directed locking element. In particular, this space extends from said support surface up to there, where the upward-directed and downward-directed locking elements cooperate. Such space provides for that the upper hook, when performing said downward movement, simply can be pressed downward until the respective locking parts engage behind each other.

in the coupled condition of two of such floor panels, a space can be present which extends from said support surface up to at least one of the one or more protrusions or up to there, where the one or more protrusions respectively cooperate with the one or more undercuts. in the coupled condition of two of such floor panels, a space can be present, which is situated above the most upward-situated protrusion.

In general, the herein above-described spaces may provide for that possible tolerances, which are present when manufacturing the coupling parts, can be accommodated.

In a preferred embodiment, said one or more protrusions and undercuts are provided with locking surfaces, which there, where they cooperate, define a tangent line which is horizontal or does not deviate more than 60 degrees from the horizontal, and more particularly does not deviate more than 50 degrees from the horizontal. Such locking surfaces provide for that a strong vertical locking can be effected among the mutually coupled floor panels, which promotes the general strength of the floor covering.

Preferably, the coupling parts are realized substantially massive. This offers the advantage that the locking can be realized strong.

Preferably, the floor panel has a thickness which is smaller than 6 mm, more preferably smaller than 5 mm and still more preferably smaller than 4 mm.

Preferably, the floor panel is substantially composed of said substrate, which comprises one or more basic layers and at least one top layer.

The top layer preferably comprises a decor which, for example, relates to a wood motif or wood pattern. The decor can be provided or more particularly printed on a carrier sheet, wherein this carrier sheet may relate, for example, to a foil or film, preferably a thermoplastic foil or film. In an alternative, the carrier sheet may relate to a paper sheet soaked in resin, on which the decor is provided, for example, by means of a print.

The top layer also may comprise a transparent or translucent wear layer situated above the decor. This wear layer may relate to a foil or film, such as a thermoplastic foil or film, however, according to an alternative it may also be a paper sheet soaked in resin.

The floor panel, or anyhow at least the substrate of the floor panel, preferably is composed substantially of synthetic material, which preferably is of the soft or supple type.

More particularly, the floor panel substantially is composed of a thermoplastic material, preferably of a soft thermoplastic material, or at least the substrate of the floor panel consists of such material.

Preferably, the floor panel is substantially realized on the basis of polyvinyl chloride, more particularly on the basis of soft polyvinyl chloride, or at least the substrate is realized on the basis of polyvinyl chloride, more particularly soft polyvinyl chloride.

In particular, the floor panel is a vinyl panel, more particularly a so-called vinyl tile. Still more particularly, it is a floor panel of the so-called LVT type ("Luxury Vinyl Tile"), or VCT type ("Vinyl Composite Tile", also called "Vinyl Composition Tile").

Other synthetic materials, on the basis of which the floor panel, or at least the substrate thereof, substantially can be formed, whether or not in combination with polyvinyl chloride, are polyethylene, polypropylene, polyethylene terephthalate or polyurethane or a combination of the above.

The substrate may comprise one or more plasticizers, wherein these plasticizers, in the case that the substrate consists of a plurality of layers, are situated in one or more layers thereof, in particular basic layers thereof.

The substrate may comprise at least one filler, such as chalk and/or limestone, wherein this filler, in the case that the substrate consists of a plurality of layers, are situated in one or more layers thereof, in particular basic layers thereof.

The substrate may comprise at least one organic filler, such as wood, cork and/or bamboo. This organic filler may be added to the substrate in the form of fibers, powder and/or dust.

In particular, the floor panel is of the WPC type ("Wood Plastic Composite") or BPC ("Bamboo Plastic Composite").

The substrate may be foamed. It then preferably shows a weight reduction of at least 10% and more, preferably a weight reduction situated between 20% and 60%.

In the case that the substrate is composed of a plurality of layers, one or more of these layers can be realized as described herein above. A particular example of such composed substrate, which can be applied in an advantageous manner in the floor panel of the present invention, is a substrate which is composed of at least two substrate layers or basic layers, whether or not situated directly on top of each other, which both substrate layers are realized on the basis of thermoplastic material. In other words, both substrate layers are realized on the basis of a thermoplastic synthetic material, such as polyvinyl chloride, polyethylene, polypropylene, polyethylene terephthalate or a combination of the above. The substrate layers each can be realized on the basis of a different thermoplastic synthetic material, however, they can also be realized on the basis of the same thermoplastic material. Preferably, however, the more upward-situated substrate layer is realized more supple than the more downward-situated substrate layer. This can be achieved in that the upper substrate layer comprises more plasticizers than the lower substrate layer. Preferably, the upper substrate layer comprises an amount of plasticizers in a quantity of more than 15 phr and more preferably even in a quantity of minimum 20 phr. The lower substrate layer, however, preferably is free from plasticizers or comprises plasticizers in an amount of less than 20 phr or in an amount between 5 and 15 phr. Further, at least one of the substrate layers and preferably both may comprise inorganic fillers, such as chalk, talc and/or limestone, and/or organic fillers, such as wood, bamboo or cork. Still preferably, at least one of the substrate layers and preferably the lower substrate layer is foamed.

A particular example of such composed substrate, which can be applied in the floor panel according to the present invention, is a substrate which is composed of a substrate layer of the WPC or BPC type and a substrate layer of the LVT type preferably situated directly there above.

The floor panel can be provided with at least one reinforcement layer, preferably of glass fiber or the like.

Although the invention preferably is applied with synthetic material-based floor panels, it may also be applied in an advantageous manner with floor panels which substantially consist of a laminate panel comprising a substrate of MDF of HDF or of a so-called engineered wood-panel.

The floor panel can be rectangular, either oblong or square, wherein said pair of opposite edges forms a first pair of opposite edges and the floor panel furthermore comprises a second pair of opposite edges. The second pair of opposite edges can also comprise coupling parts, which coupling parts allow a locking in a first direction perpendicular to the respective edges and in the plane of the floor panel, as well as in a second direction perpendicular to the plane of the floor panel.

The coupling parts on the second pair of opposite edges preferably are configured such that two of such floor panels, on this second pair of opposite edges, can be coupled by means of a turning movement of one floor panel in respect to the other floor panel, in such a manner that a plurality of such floor panels can be coupled by means of a so-called "fold-down" technique.

Preferably, the coupling parts on the second pair of opposite edges substantially are realized in the material of the floor panel itself, and more particularly in said substrate, and more preferably are realized entirely in one piece therewith.

Most preferably, the floor panel is oblong rectangular, and the first pair of opposite edges forms the short sides of the floor panel and the second pair of opposite edges forms the long sides of the floor panel. In an alternative, the first pair of opposite edges forms the long sides of the floor panel and the second pair of opposite edges forms the short sides of the floor panel.

The invention shows its benefits best when it is applied with floor panels which can be coupled to each other by means of a so-called "fold-down" technique. By this "fold-down" technique, a technique is intended as described, amongst others, in the patent documents WO 01/75247 and WO 01/02669, wherein thus the coupling parts on a pair of opposite edges are configured such that two of these floor panels can be coupled to each other at these edges by means of a turning movement, wherein thereby, due to the scissor movement on the other pair of opposite edges, also automatically a coupling is achieved at these edges. In the case of oblong floor panels, the last-mentioned pair of edges preferably is formed by the short sides of the floor panel.

It is noted that by "massive" has to be understood that no weakened portions and/or recesses are provided in order to allow certain deformations. Herein, it is also noted that by "substantially massive" is meant that, although such weakened parts and/or recesses are not excluded, these extend only to a limited extend over the portion in which they are provided.

It is also noted that the support surfaces may or may not be curved, which also is valid for the locking surfaces.

It is also noted that all characteristics of the independent aspects can be combined at choice, as far as they are not contradictory.

BRIEF DESCRIPTION OF THE DRAWINGS

With the intention of better showing the characteristics of the invention, herein below, as an example without any limitative character, some preferred embodiments are described, with reference to the accompanying drawings, wherein.

DETAILED DESCRIPTION OF PREFERRED EMBODIMENTS OF THE INVENTION

Figure 1:
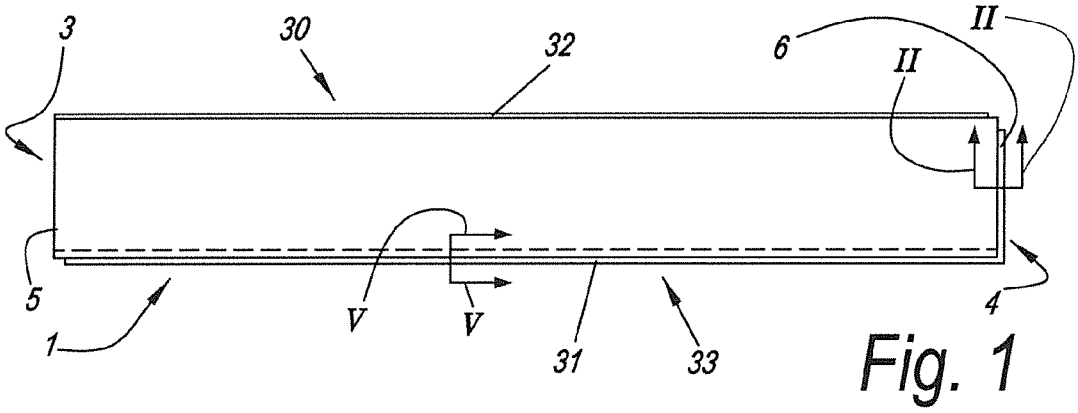
FIG. 1 in top view represents a floor panel according to the invention.

FIG. 1 in top plan view represents a floor panel 1 according to the present invention.

The floor panel 1 comprises coupling parts 5-6 on at least one pair of opposite edges 3-4.

Figure 2:
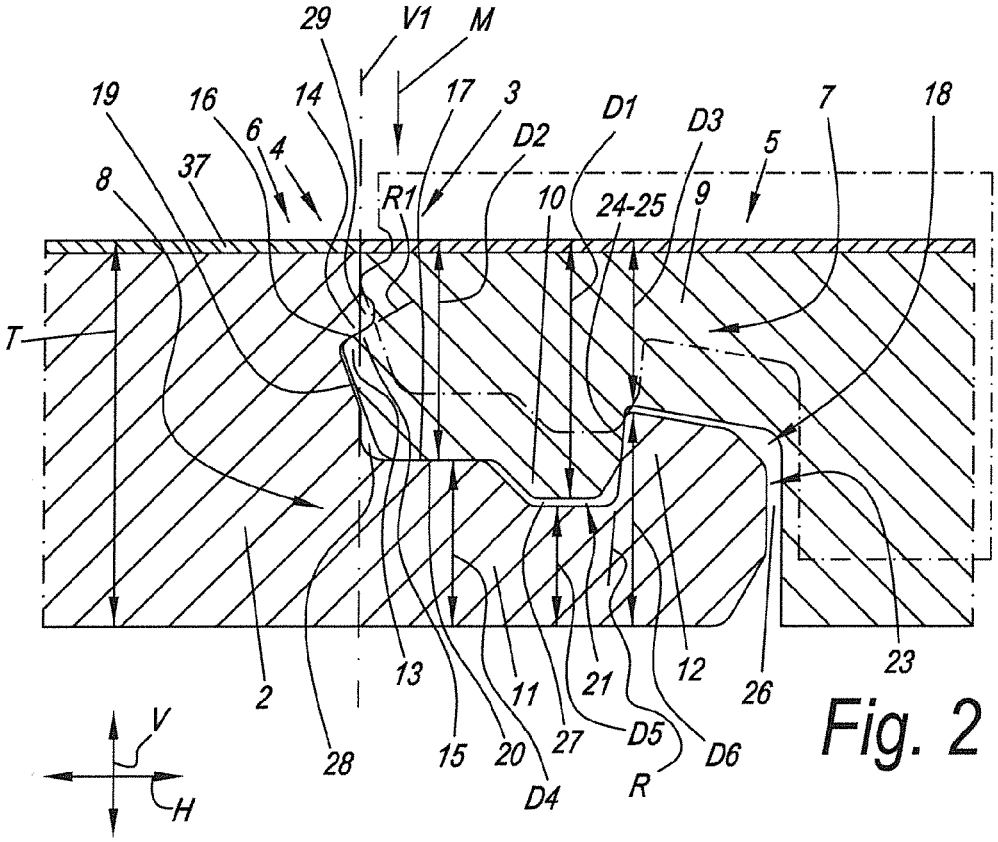
FIG. 2 represents a cross-section according to line II-II in FIG. 1, however, in the coupled condition of two of such floor panels.

FIG. 2 represents a cross-section according to line II-II in FIG. 1, however, in the coupled condition of two of such floor panels 1.

The floor panel 1 is at least composed of a substrate 2 and in the represented example also of a top layer 37 situated above the substrate. The substrate 2 and the top layer 37 can be realized such as described herein above in the introduction.

The floor panel 1 has a thickness T which preferably is smaller than 6 mm, more preferably smaller than 5 mm and still more preferably smaller than 4 mm.

The coupling parts 5-6 are substantially formed of the material of this substrate 2 and are made in one piece therewith. Moreover, they are substantially made massive.

The coupling parts 5-6 allow that two of such floor panels 1 can be coupled to each other by means of a downward movement M of one floor panel 1 in respect to the other floor panel 1.

Further, the coupling parts 5-6, in the coupled condition, form a first locking system which effects a locking in a first direction V perpendicular to the plane of the floor panels 1, as well as a second locking system which effects a locking in a second direction H perpendicular to the edges 3-4 and in the plane of the floor panels 1.

The second locking system is at least formed of a downward-directed upper hook-shaped part 7, which is situated on the one edge 3, as well as an upward-directed lower hook-shaped part 8, which is situated on the other, opposite edge 4. These hook-shaped parts 7-8 can be engaged behind each other by means of said downward movement M.

The upper hook-shaped part 7 consists of a lip 9 with a downward-directed locking element 10, whereas the lower hook-shaped part 8 consists of a lip 11 with an upward-directed locking element 12.

The first locking system comprises locking parts 13-14 in the form of one or more protrusions 15, which in the coupled condition respectively cooperate with one or more undercuts 16. In the example represented here, the first locking system comprises one protrusion 15, which in the coupled condition cooperates with one recess 16.

The protrusion 15 is situated in the proximity of the distal extremity of the upper hook-shaped part 7, and the recess 16 is situated in the proximity of the proximal extremity of the lower hook-shaped part 8.

The protrusion 15 and the undercut 16 are provided with locking surfaces, which there, where they cooperate, define a tangent line R1, which is horizontal or does not deviate more than 60 degrees from the horizontal, and preferably does not deviate more than 50 degrees from the horizontal. In the represented example, the tangent line R1 deviates 30 degrees from the horizontal.

The lip 9 of the upper hook-shaped part 7 is provided with a support surface 17, with which this upper hook-shaped part 7 in the coupled condition rests on the lip 11 of the lower hook-shaped part 8. In the represented example, the support surface 17 is situated horizontally.

The lip 9 of the upper hook-shaped part 7 is provided with an upward-directed recess 18, in which said upward-directed locking element 12 in the coupled condition is situated at least partially.

The support surface 17 is situated closer to the distal extremity of the upper hook-shaped part 7 than said downward-directed locking element 10, which in its turn is situated closer to said distal extremity than said upward-directed recess 18.

The most upward-situated point of the upward-directed recess 18 is situated higher than said support surface 17, which in its turn is situated higher than the most downward-situated point of said downward-directed locking element 10.

The distal extremity of the protrusion 15 is situated farther distal than a vertical closing surface V1, which is formed between the two coupled floor panels 1.

The distance D1 between an upper side of the floor panel 1 and the most downward-situated point of said downward-directed locking element 10 is at least 1.1 times larger than the distance D2 between the upper side of the floor panel 1 and the most downward-situated point of said support surface 17, and more preferably is at least 1.15 times larger.

The distance D2 is at least 1.2 times larger than the distance D3 between the upper side of the floor panel 1 and the most upward-situated point of said upward-directed recess 18 and preferably is at least 1.3 times larger.

The distance D3 is less than half of the overall thickness T of the floor panel 1.

The proximal extremity of the upper hook-shaped part 7 and the distal extremity of the lower hook-shaped part 8 are free from locking parts.

In the represented example, the upper hook-shaped part 7 comprises one guiding surface 19, which extends downward in an inclined manner, starting from the protrusion 15. The guiding surface 19 extends downward in an inclined manner at an angle of at least 10 degrees with a vertical and preferably at an angle of at least 15 degrees with the vertical. In the represented example, the guiding surface extends at an angle of 20 degrees with the vertical.

The lip 11 of the lower hook-shaped part 8 is provided with a support surface 20, on which the lip 9 of the upper hook-shaped part 7 rests in the coupled condition. In the example represented here, the support surface 20 is situated horizontal.

The lip 11 of the lower hook-shaped part 8 further is provided with a downward-directed recess 21 in which said downward-directed locking element 10 in the coupled condition is situated at least partially.

The support surface 20 is situated closer to the proximal extremity of the lower hook-shaped part 8 than said downward-directed recess 21, which in its turn is situated closer to the proximal extremity of the lower hook-shaped part 8 than said upward-directed locking element 12.

The most upward-situated point of the upward-directed locking element 12 is situated higher than said support surface 20, which in its turn is situated higher than the most downward-situated point of said downward-directed recess 21.

The distance D4 between a lower side of the floor panel 1 and the most downward-situated point of said support surface 20 is at least 1.2 times larger than the distance D5 between the lower side of the floor panel 1 and the most downward-situated point of said downward-directed recess 21, preferably is at least 1.3 times larger and still more preferably at least 1.35 times larger.

The distance D6 between a lower side of the floor panel 1 and the most upward-situated point of said upward-directed locking element 12 is at least 1.1 times larger than the distance D4 and preferably at least 1.2 times larger and still more preferably at least 1.25 times larger.

The distance D6 is more than half of the overall thickness T of the floor panel 1.

The downward-directed locking element 10 is provided with a locking surface 24 which, in the coupled condition, cooperates with an adapted thereto locking surface 25 of the upward-directed locking element 12. These locking surfaces 24-25 define there, where they work in conjunction, a tangent line R1 which is situated vertically or does not deviate more than 45 degrees from the vertical. In the represented example, the tangent line R deviates 5 degrees from the vertical.

In the coupled condition, a space 26 is present in the entire intermediary space between a distal side 23 of the upward-directed locking element 12 of the one floor panel 1 and the edge of the other floor panel 1. This space 26 extends up to below the lip 9 of the upper hook-shaped part 7.

Underneath the downward-directed locking element 10, a space 27 is present in the coupled condition. This space 27 extends more particularly from the support surface 17 or 20 up to there, where the locking elements 10 and 12 cooperate.

In the coupled condition, there is also a space 28 present, which extends from the support surface 17 or 20 up to the protrusion 15 or up to there, where the protrusion 15 cooperates with the undercut 16.

Above the protrusion 15 there is still another space 29.

Figure 3:
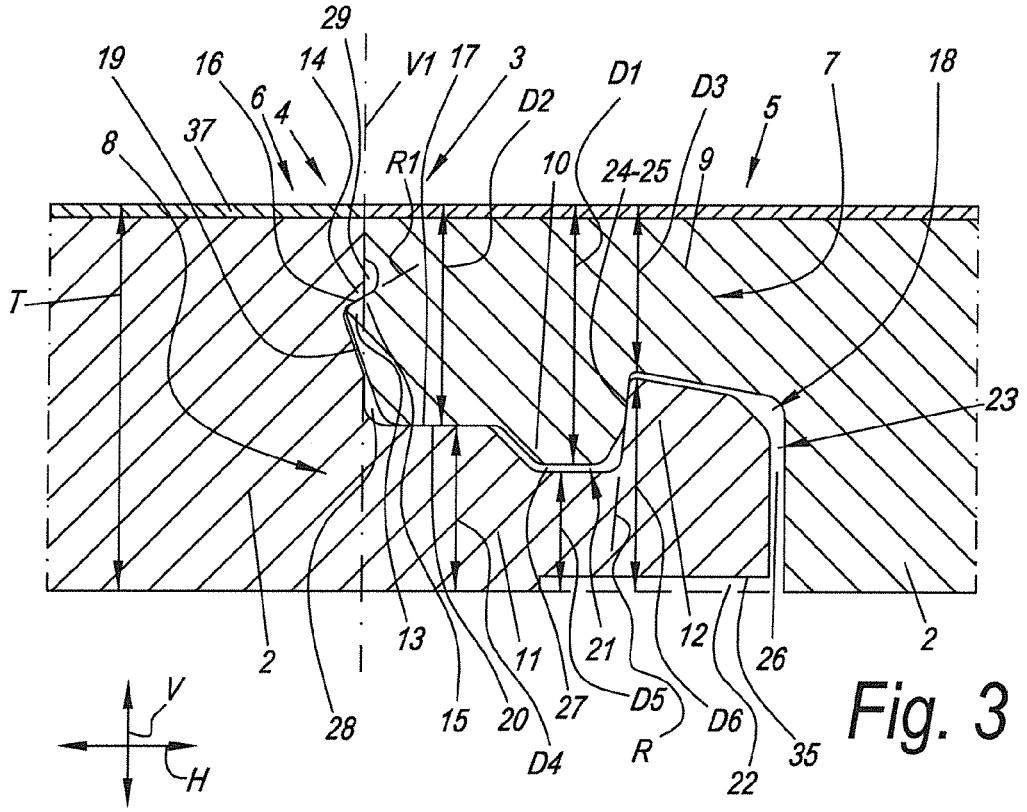
FIG. 3 represents a variant of FIG. 2.

In FIG. 3, a variant of FIG. 2 is represented, wherein the lip 11 of the lower hook-shaped part 8 comprises an incision 22. The incision 22 is situated on the lower side of the lip 11. The incision 22 extends in horizontal direction and preferably from a distal side 23 of the upward-directed locking element 12. The incision 22 can extend up to at least there, where the downward-directed and upward-directed locking elements 10 and 12 cooperate with each other.

Figure 4:
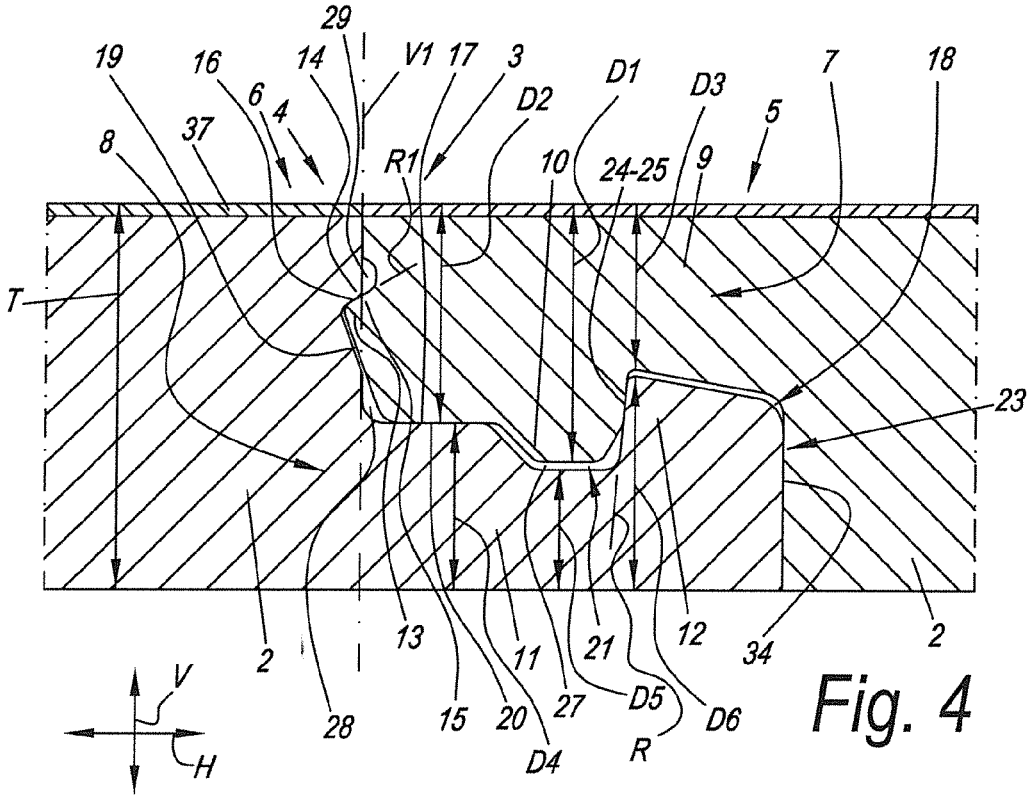
FIG. 4 represents another variant of FIG. 2.
Figure 5:
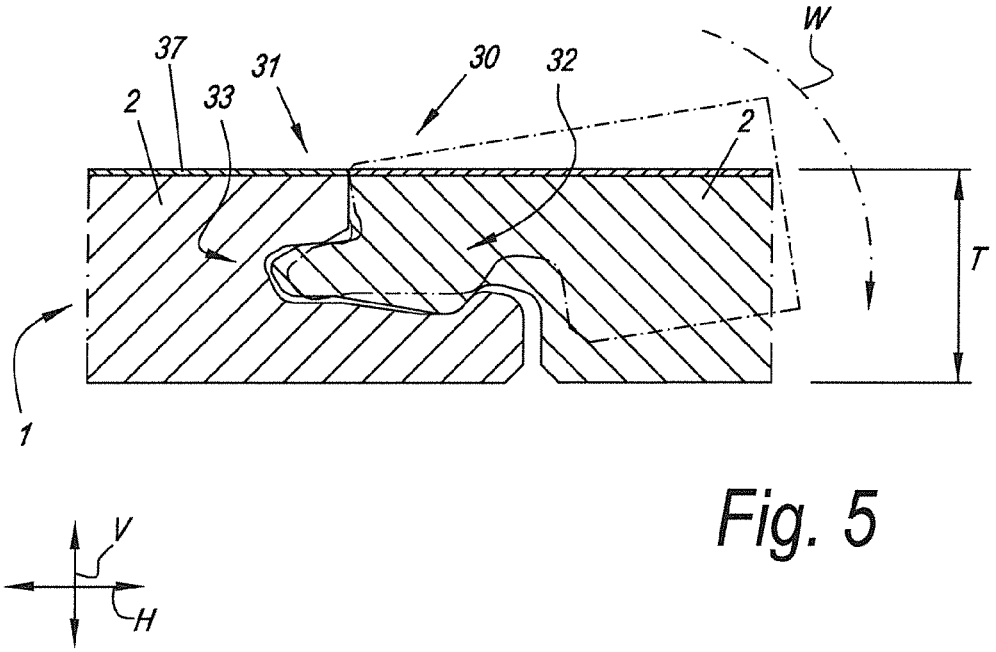
FIG. 5 represents a cross-section according to line V-V in FIG. 1, however, in the coupled condition of two of such floor panels.

The incision 22 has an upper side 35. As represented in FIG. 3, the upper side 35 can be situated substantially horizontal or, in other words, can be situated substantially parallel to the plane of the floor panel. According to an alternative, however, the upper side 35 can be inclined as well. An example of such inclined incision is represented in FIGS. 4 and 5 of the document WO 2014/182215. According to another alternative, the upper side 35 can be curved and thus not flat.

The incision 22 allows that the lip 11, or at least a part of this lip 11, can be bent downward. This allows that the edge 3, during coupling of the floor panels 1, can be pressed downward until a locking position is achieved between the floor panels 1, i.e. a position in which the hook-shaped parts 7-8 engage one behind the other. By means of the incision 22, the floor panels 1 can be coupled to each other in a relatively smooth manner. Also, a difference in thickness among floor panels 1, and in particular a difference in thickness on the edges 3-4 of the floor panels 1, can be compensated. Further information is given by means of FIGS. 7 and 8.

It is also noted that FIG. 4 represents a variant according to the invention, wherein in the coupled condition of two of such floor panels 1, on the pair of opposite edges 3-4 a contact 34 is formed between a distal side 23 of the upward-directed locking element 12 and the edge of the other floor panel 1, and in particular there is no space 26 present. The inventor has found that such contact enhances the dimensional stability of the floor panel, in particular with a floor panel with a substrate which substantially consists of thermoplastic material and/or fillers, and more particularly offers the possibility of limiting and preferably preventing shrinkage and extension, or possibly warping, under the influence of temperature.

It is also noted that the contact 34, as represented in FIG. 4, extends up to the lower side of the floor panels; however, this does not necessarily have to be so. Such contact may extend, for example, up to a certain distance from the lower side of the floor panel, such that also a space is provided below said contact.

As represented in FIG. 1, the floor panel 1 is rectangular and here more particularly oblong. The floor panel 1 thus comprises a short pair of sides, which are formed by the herein above-described edges 3-4, and a pair of long sides, which are formed by the edges 30-31. These edges 30-31 also comprise coupling parts 32-33.

FIG. 5 represents a cross-section according to line V-V in FIG. 1, however, in the coupled condition of two of such floor panels 1.

The coupling parts 32-33 are realized substantially in the material of the floor panel 1 itself, and more particularly in said substrate 2, and preferably are realized entirely in one piece therewith.

The coupling parts 32-33 allow a locking in a first direction H perpendicular to the respective edges 30-31 and in the plane of the floor panel 1, as well as a locking in a second direction V perpendicular to the plane of the floor panel 1.

Further, the coupling parts 32-33 are configured such that two of such floor panels 1 can be coupled by means of a turning movement W of one floor panel 1 in respect to the other floor panel 1, in such a manner that a plurality of such floor panels 1 can be coupled by means of a so-called "fold-down" technique, which will be described in greater detail by means of FIG. 6.

Figure 6:
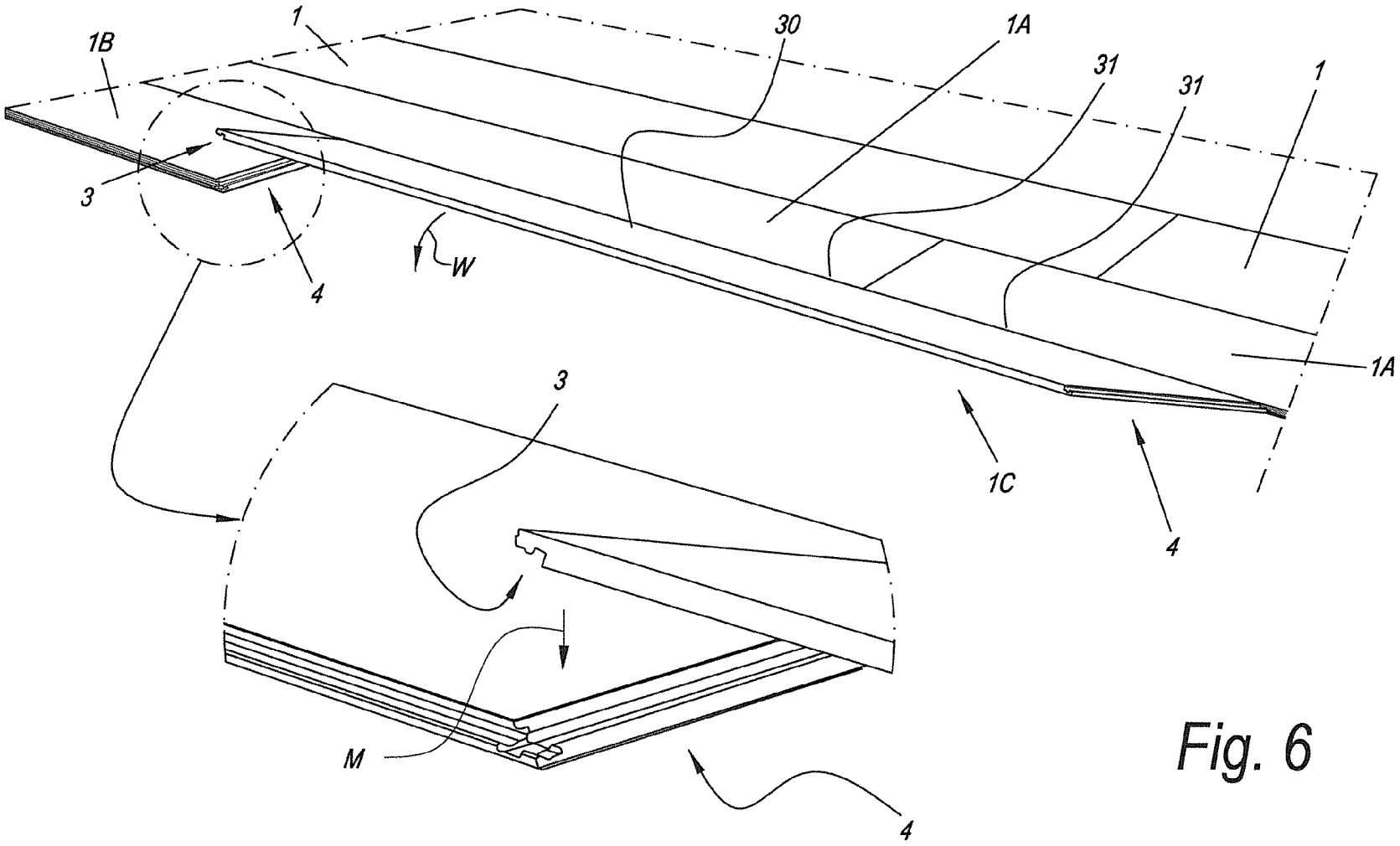
FIG. 6 represents how such floor panels can be coupled to each other by means of the so-called "fold-down" technique.

FIG. 6 represents how the floor panels 1 of FIG. 1 can be coupled by means of the so-called "fold-down" technique. In the figure, a partially finished floor covering is shown with, amongst others, a row of already installed floor panels 1A and a row with the already installed floor panel 1B. The floor panel 1C has to be installed in the row of the floor panel 1B and thus has to be coupled to the floor panels 1A and 1B. More particularly, the floor panel 1C must be coupled with its long edge 3 to the short edge 4 of the floor panel 1B.

The fold-down movement is performed by turning the floor panel 1C downward, starting from an inclined position with its coupling part 32 already partially introduced into the coupling part 33 of the floor panels 1A, according to a movement W. During this movement, the long edges 30-31 are coupled to each other and at the same time the short edges 3-4 are coupled by the downward movement M, which is combined with the turning movement W. Thus, the floor panel 1C, in other words, is coupled in one and the same movement W at its long edge 30 as well as at its short edge 3 to the already installed floor panels 1A-1B.

Figure 7:
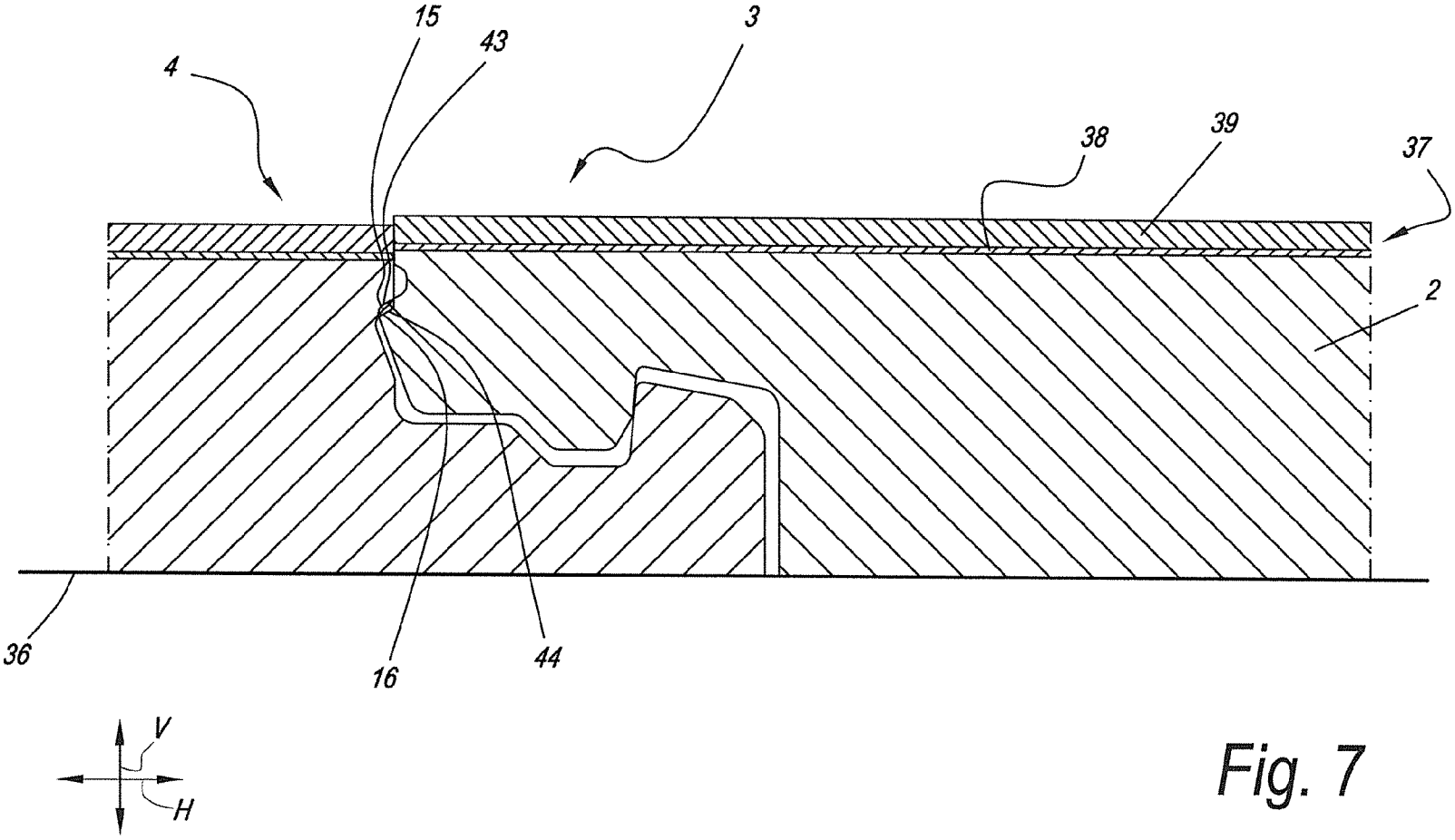
FIG. 7 represents coupled floor panels which show a mutual height difference.

In FIG. 7, two floor panels are represented, which are installed on an underlying surface or subfloor 36. The floor panels have a different thickness. This may be due to tolerances which are allowed during manufacturing of the floor panels. As the floor panels show such thickness difference, various portions of the coupling parts may be situated at different heights of the floor panels. In the embodiment represented in FIG. 7, the locking surface 43 of the protrusion 15, for example, is situated higher than the locking surface 44 of the undercut 16, as a result of which the protrusion 15, as represented, does not fit into the undercut 16. Hereby, it is possible that the floor panels cannot be coupled in a smooth manner or that a locking position between the floor panels is not obtained. As already mentioned earlier, a possible solution for accommodating such thickness difference is providing an incision 22, such as described herein above.

Figure 8:
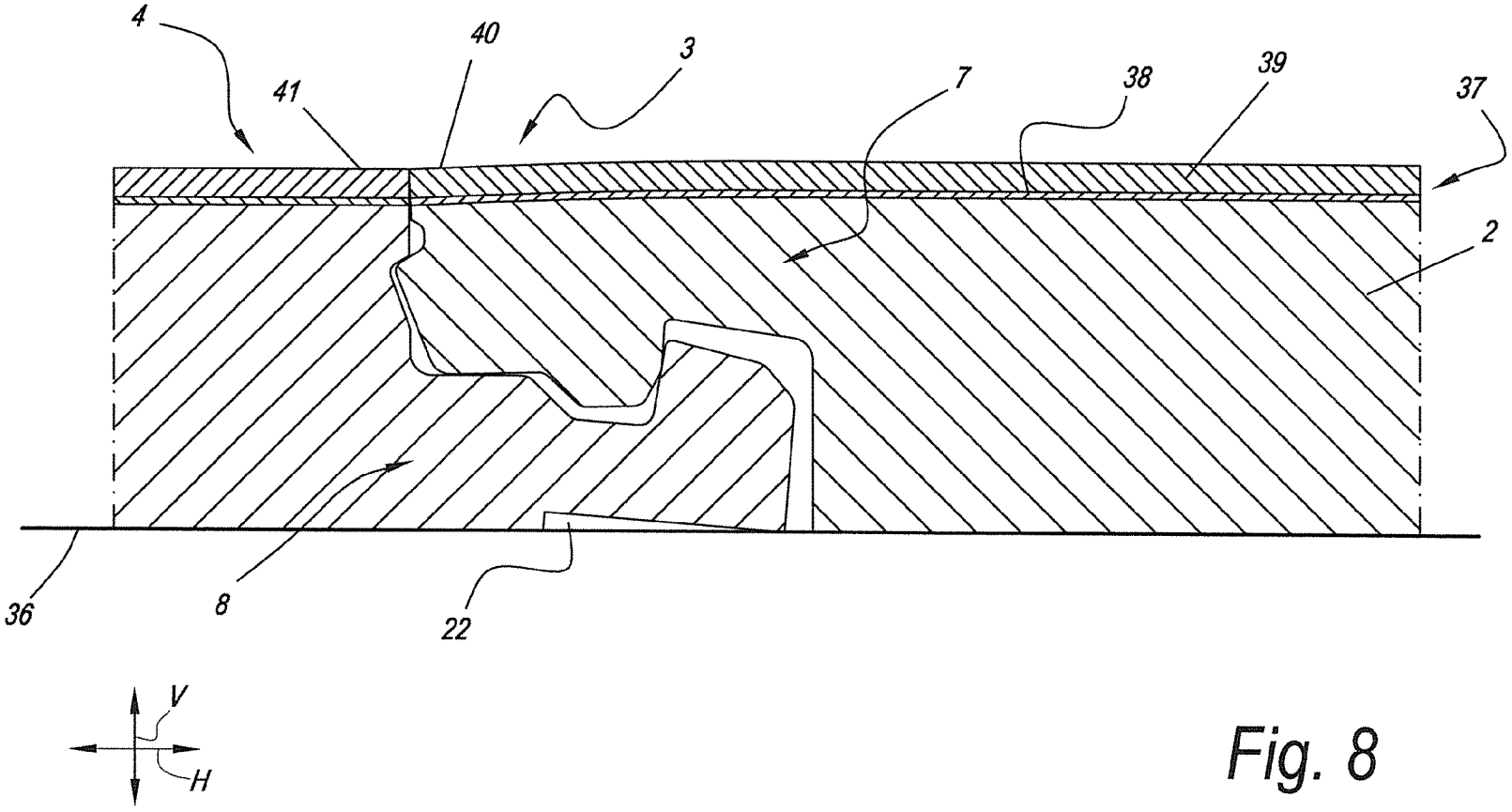
FIG. 8 represents floor panels according to FIG. 3, wherein the floor panels, however, show a mutual difference in thickness.

In FIG. 8, floor panels according to the invention are represented, which are installed on an underlying surface or subfloor 36. Just as in FIG. 7, these floor panels show a mutual thickness difference. The floor panel with the lower hook-shaped part 8 shows an incision 22 as described herein above, which can accommodate the thickness difference between the floor panels. To this aim, the incision 22 allows that the edge 3 can be pressed down until a locking position among the floor panels is achieved. More particularly, the incision 22 allows that the edge 3 can be bent down until the hook-shaped parts 7-8 engage behind each other. Herein, the edge 3 can be displaced until an upper side 40 of the one floor panel is aligned with an upper side 41 of the other floor panel, as represented in FIG. 8.

It is also noted that in FIGS. 7 and 8 a multi-layered top layer 37 is represented. The top layer 37 may consist of a decor layer 38 and a transparent wear layer 39. The top layer may also comprise one or more other layers, such as, for example, an UV coating on top of the transparent wear layer. It is noted that such multi-layered top layer 37 does not necessarily have to be provided on the floor panels.

Figure 9:
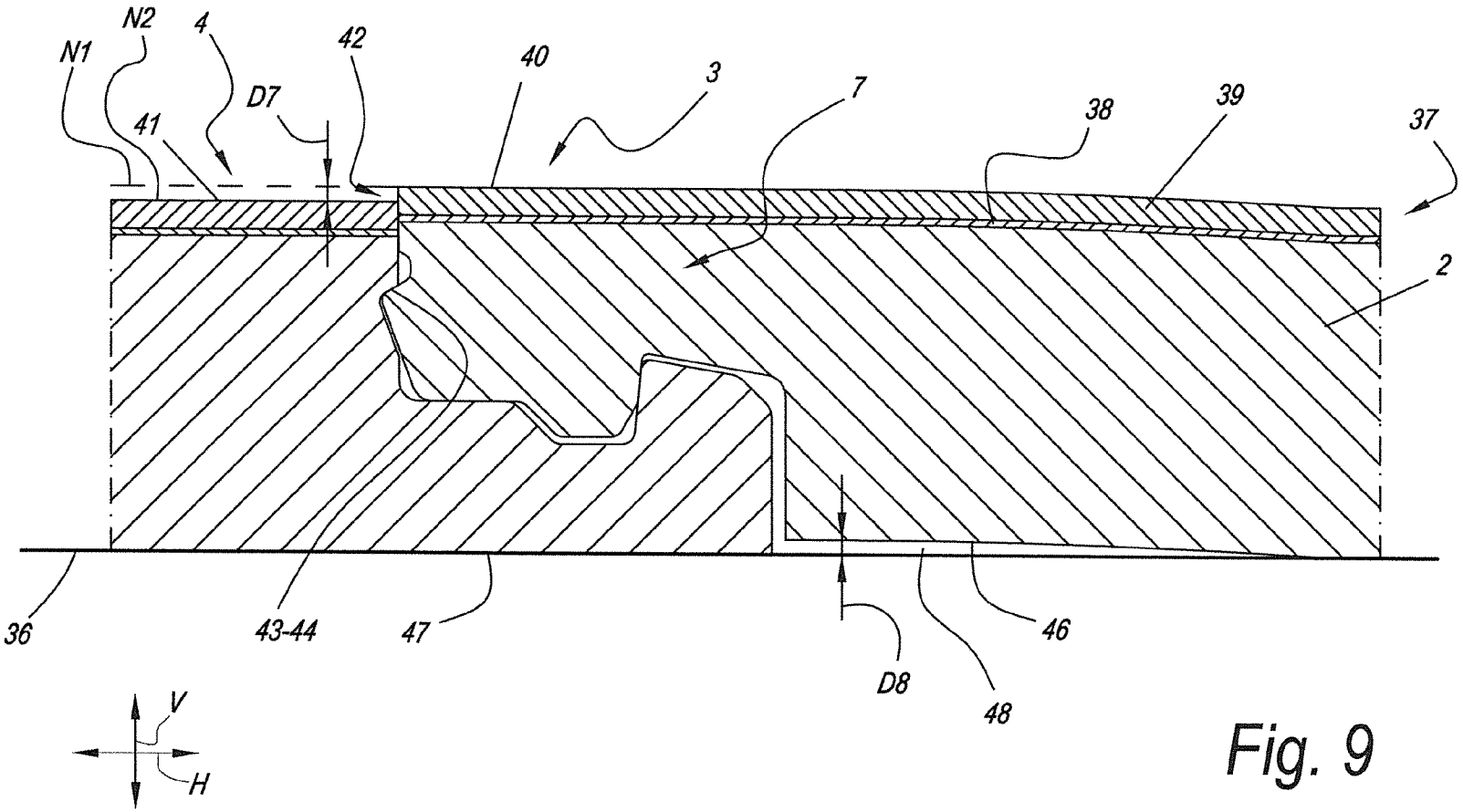
FIG. 9 represents another variant to FIG. 2.

In FIG. 9, floor panels according to the invention are represented, wherein in the proximity of the edges 3-4 of these floor panels a height difference 42 is provided between the coupled floor panels. More particularly, an upper side 40 of the one floor panel, where this upper side 40 extends over the hook-shaped part 7, is situated on a first level N1, which is situated higher than a second level N2, on which an upper side 41 of the other floor panel is situated, there, where this upper side 41 extends over the core of the respective floor panel.

Such height difference 42 allows accommodating a thickness difference among floor panels, such as described herein above. The height difference 42 in fact allows that the coupling parts can be made fitting irrespective of the thickness difference present among the floor panels. By this is meant that the coupling parts of the floor panels to be coupled fit into each other when these floor panels are coupled to each other, contrary to the non-fitting coupling parts represented in FIG. 7.

In order to optimally accommodate a thickness difference among floor panels, the vertical distance D7 between the levels N1 and N2 preferably is substantially equal to or larger than an average variation in thickness among the floor panels. Still more preferably, this distance D7 is substantially equal to or larger than a thickness difference between the floor panels at the edges 3-4 thereof. In particular, the distance D7 is situated between 0.01 mm and 0.15 mm, preferably between 0.03 mm and 0.10 mm, wherein 0.06 is a good value.

In a preferred practical embodiment, the locking surfaces 43-44 of the first locking system, which more particularly are contact surfaces, are chosen such that in the coupled condition of the floor panels said upper sides 40-41 are situated at the levels N1 and N2 concerned. This is explained in greater detail by means of FIGS. 10 and 11, which represent a possibility in which a height difference 42 according to the invention can be realized.

Figure 10:
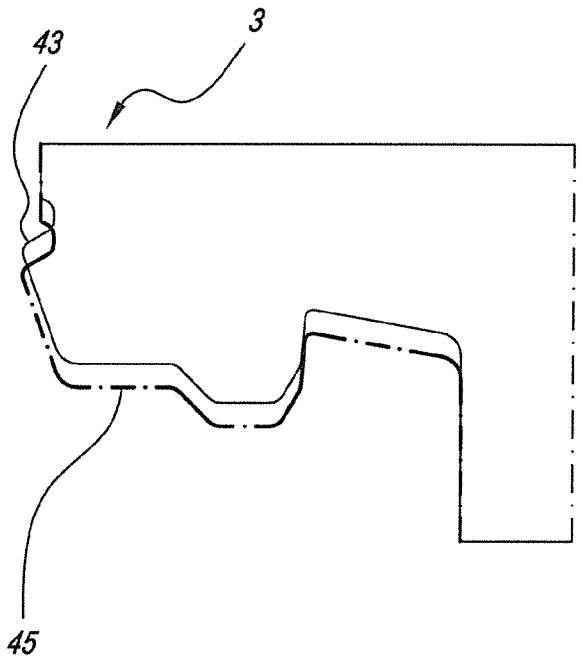
FIGS. 10 and 11 represent a possibility according to which a height difference according to the invention can be realized.

In FIG. 10, the floor panel with edge 3 of FIG. 7 is represented. However, only the contour of this floor panel is represented. As already is stated in respect to FIG. 7, the coupling parts of the floor panels of FIG. 7 do not fit into each other; to wit, the contact surfaces 43-44 are situated at different heights. According to the invention, however, these contact surfaces 43-44 can be chosen such that in fact it is possible to make the coupling parts to fit. To this aim, for example, the contact surface 43, whether or not together with the remainder of the provided profiled part at the edge 3, can be realized lower in the respective floor panel and thus so to speak displaced downward. In the case of FIG. 10, the entire profiled part of the edge 3 is realized lower in the floor panel, such as shown by the downward-displaced profiled part 45. The downward-displaced profiled part 45 in fact allows coupling the floor panels to each other to fit, as represented in FIG. 11.

Figure 11:
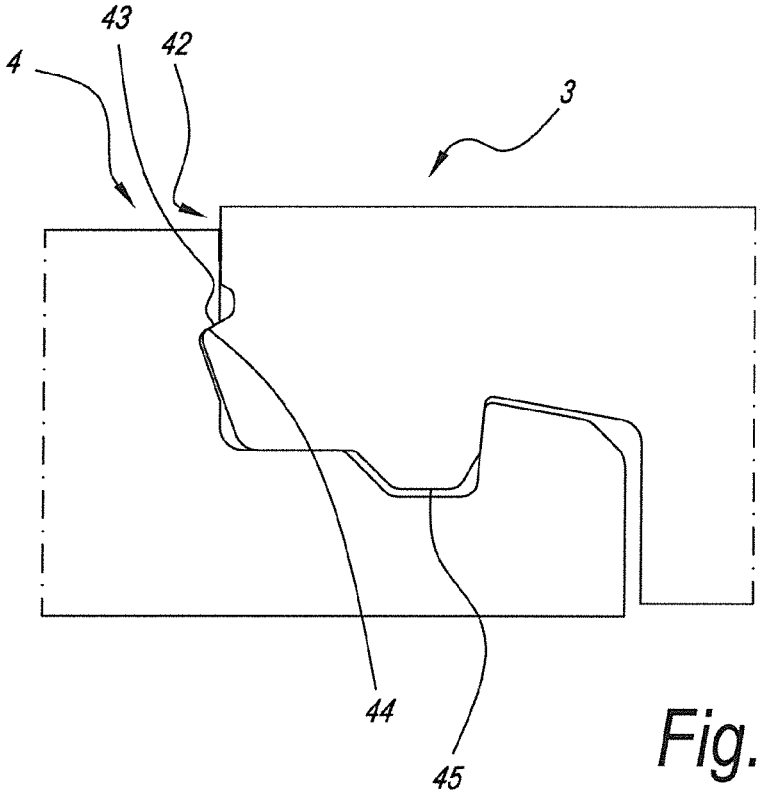

In FIG. 11, the floor panels of FIG. 7 are represented, however, limited to the contours thereof, and with the adapted profiled part 45 at the edge 3. As represented, the coupling parts in fact fit into each other. The contact surfaces 43-44 are situated at the same height and are chosen such that a height difference 42 is formed. This height difference 42 is equal or approximately equal to the distance over which the contact surface 43 is displaced in downward direction, as explained in connection with FIG. 10. The height difference 42 can be larger than the thickness difference among the floor panels, however, this does not necessarily have to be so. The height difference 42, however, can also be approximately equal or equal to the thickness difference among the floor panels.

According to a particular embodiment, a lower side 46 of the one floor panel, next to the edge 3, is situated on a level which is located higher than a lower side 47 of the other floor panel. In other words, a space 48 is formed between the lower side 46 and the subfloor 36. This may be the case when the distance D7 between the aforementioned first level N1 and the aforementioned second level N2 is larger than a thickness difference among the floor panels. The maximum distance D8 between the lower side 46 and the subfloor 36 can be approximately equal or equal to the distance D7. This can be the case, amongst others, when there is no thickness difference among the floor panels, which is the case in FIG. 9.

Preferably, the lower side 46 extends uninterruptedly to the edge 3, such that a possible space 48 between the floor panel and the subfloor 36 is formed by the aforementioned lower side 46.

The lower side 46 can be realized substantially flat. By this is meant that this lower side 46 is free from recesses or grooves; however, it is not excluded that this lower side 46 is bent out in the installed condition of the floor panels and thus shows a certain curvature, as represented in FIG. 9, in particular when such space 48 is present. The upper side 40, and in general the entire floor panel with edge 3, can be bent out, in particular in the presence of such space 48.

Figure 12:
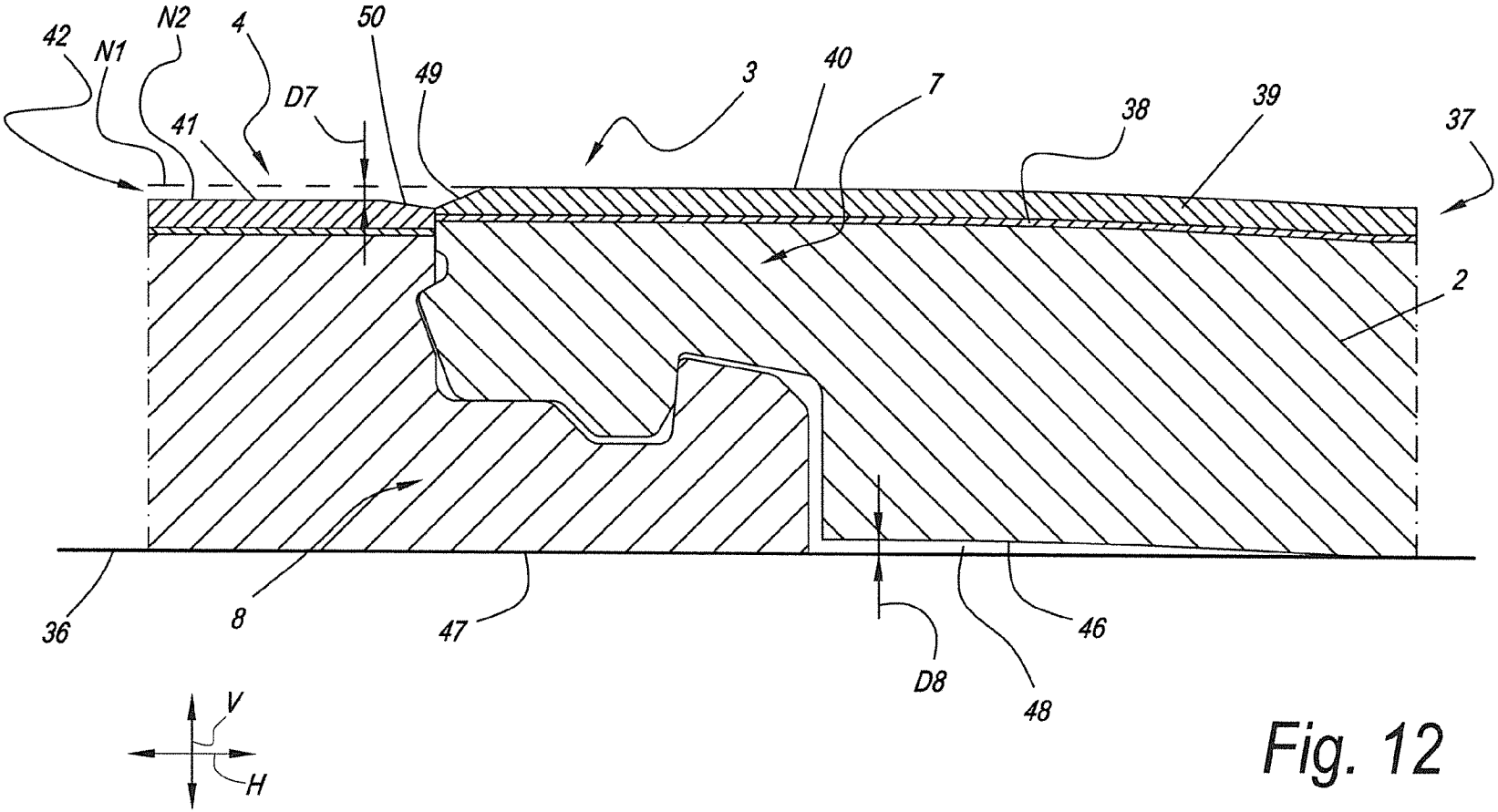
FIG. 12 represents a variant of FIG. 9.

In FIG. 12, a variant to the embodiment shown in FIG. 11 is represented. Herein, the upper side 40, in the coupled condition of the floor panels, is situated at the same level as the upper side 41 there, where they adjoin each other by means of a bevel 49. The mentioned height difference 42 between the floor panels is accommodated thereby, anyhow at least visually.

The bevel 49 may be situated on an upper edge of the floor panel with the upper hook-shaped part 7. In the embodiment shown in FIG. 12, also an upper edge of the floor panel with the lower hook-shaped part 8 is provided with a bevel 50, which does not have to be necessarily so. The height difference 42 can already be accommodated at least visually by a single bevel, which is provided on an upper edge of one of the floor panels.

The bevels 49-50 are realized differently, such that these bevels 49-50, in the coupled condition of the floor panels, are situated on an equal level, there, where they adjoin each other.

In particular, said bevel 49 can be formed by an inclined part of the upper side 40, and more particularly be formed by a chamfer. The bevel 49 can be provided with a decoration. This decoration can be formed by a separate decorative layer, which is provided on the bevel 49. This decorative layer can be formed by a lacquer, a print, more particularly a digital print, and the like. According to an alternative, the bevel 49 can be formed by an impression of the top layer 37, which is provided on the floor panel concerned.

The upper side of the bevel 49 can extend in the transparent wear layer 39 and preferably be formed thereby, as represented in FIG. 12. According to an alternative, the upper side of the bevel 49 can be formed at least partially by the decor layer 38 and/or the material of the substrate 2.

It is also noted that the above-mentioned characteristics in respect to the bevel 49 can also be applied to the bevel 50, or can only be applied to the bevel 50.

It is also noted that within the scope of the invention, by a "height difference" a height difference must be understood which differs from a rather random height difference, which, for example, has occurred due to allowed tolerances during the manufacturing process of the floor panels. A height difference according to the invention is a height difference which is provided deliberately, to with by deliberately chosen adjustments, more particularly adjustments in respect to the mechanical treatments in order to manufacture the coupling parts.

All figures are solely schematic, wherein relevant distances and ratios, as represented in the figures, do not necessarily have to correspond to floor panels realized in reality. Thus, for the relevant distances and ratios primarily those stated in the description have to be taken into account.

It is also noted that providing a height difference among floor panels, more particularly in the proximity of edges of these floor panels, as such forms an inventive idea. Such height difference can be applied in an advantageous manner with a set of floor panels which at least consists of a first floor panel and a second floor panel, wherein the first floor panel comprises a first edge, which is provided with a male coupling part, and the second floor panel comprises a second edge, which is provided with a female coupling part, wherein these coupling parts allow that the aforementioned floor panels can be coupled to each other at the aforementioned edges by means of a downward movement of the first edge relatively in respect to the second edge, and wherein the aforementioned coupling parts, in the coupled condition of the floor panels, form a first locking system, which effects a locking in a first direction perpendicular to the plane of the floor panels, as well as form a second locking system, which effects a locking in a first direction perpendicular to the edges and in the plane of the floor panels. Such type of set of floor panels as such is known, amongst others, from the document WO 2014/182215.

A general problem with such set of floor panels is that due to allowed tolerances during the manufacture of the floor panels, a difference in thickness may arise among a plurality of floor panels from the set. Such thickness difference may render coupling the floor panels to each other more complicated and/or may prevent obtaining a locking position among the floor panels. This issue is already described herein above and is also known in the state of the art, and this, amongst others, from said document WO 2014/182215.

From the document WO 2014/182215, it is known to provide the floor panel with the male coupling part with a calibrating groove. By providing such calibrating groove, a distance is created between a lower side of the floor panel and a subfloor on which the floor panel is installed. This distance allows that the floor panel with the male coupling part can be pressed down during coupling of the floor panels, until a locking position among the floor panels is obtained. However, a possible disadvantage of such groove is that an additional process step is necessary during manufacturing of the floor panels in order to provide this groove. Such additional process step may lead to longer cycle times in the manufacture of the floor panels. Another disadvantage is that an additional instrument is necessary for manufacturing the calibrating groove.

Amongst others, the present invention aims at an alternative set of floor panels of the aforementioned type, wherein according to various preferred embodiments one or more problems with the floor panels of the state of the art are solved.

To this aim, the present invention, according to an independent aspect thereof, relates to a set of floor panels of the aforementioned type, with the characteristic that in the coupled condition of the first and the second floor panel an upper side of the first floor panel, there, where this upper side extends over the male coupling part, is situated on a first level which is situated higher than a second level, on which an upper side of the second floor panel is situated there, where this upper side of the second floor panel extends over the core of the second floor panel. In other words, in the proximity of the edges of the coupled floor panels a height difference is provided between these floor panels. In that such height difference is provided, the advantage is created that a difference in thickness among floor panels, and more particularly a difference in thickness at the edges of the floor panels, can be accommodated. Another advantage is that the floor panels can be coupled to each other in a relatively smooth manner. Still another advantage is that no additional process steps or extra tools are necessary in order to provide the aforementioned height difference. For a better understanding of the mentioned and other advantages, amongst others, reference is made to the detailed description of FIGS. 9 to 12.

Preferably, the vertical distance between said first and said second level is substantially equal to or larger than an average variation in thickness among the floor panels. More particularly, this distance is substantially equal to or larger than a thickness difference between the first and the second floor panel on the first and second edges. In particular, said distance is situated between 0.01 mm and 0.15 mm, and preferably between 0.03 mm and 0.10 mm, wherein 0.06 mm is a good value.

In a practical embodiment, the aforementioned first locking system is formed by locking surfaces, more particularly contact surfaces, which are chosen such that in the coupled condition of the floor panels said upper sides are located on the respective levels.

In particular, a lower side of the first floor panel, in the proximity of the first edge, is located on a level which is situated higher than a lower side of the second floor panel. This may be the case, for example, when the distance between the aforementioned first and second level is larger than a difference in thickness between the floor panels.

Preferably, a lower side of the first floor panel extends uninterruptedly up to the first edge, such that a possible space between the first floor panel and an underlying surface is at least partially bordered by said lower side.

Preferably, a lower side of the first floor panel can be made substantially flat. By this is meant that this lower side is free from recesses or grooves; however, it is not excluded that this lower side is bent out in the installed condition of the floor panels and thus shows a certain curvature, in particular when a space is present between the first floor panel and a subfloor or underlying surface. As the lower side is free from recesses or grooves, the advantage is obtained that the floor panel can be realized stable and strong.

Preferably, the first floor panel has a substantially uniform thickness.

According to a preferred embodiment, said upper side of the first floor panel, in the coupled condition of the floor panels, is situated on the same level as the aforementioned upper side of the second floor panel, there, where they adjoin each other by means of a bevel. Hereby, the advantage is obtained that the mentioned height difference among the floor panels is accommodated, anyhow at least visually.

Preferably, the aforementioned bevel either is situated on an upper edge of the first floor panel, or on an upper edge of the second floor panel, or bevels are provided on an upper edge of the first floor panel as well as on an upper edge of the second floor panel. In the last-mentioned embodiment, the bevel of the first floor panel is made different from the bevel of the second floor panel, such that the bevels, in the coupled condition of the floor panels, there, where they adjoin each other, are situated on an equal level.

In particular, said bevel can be formed by an inclined portion of the upper side of the respective floor panel, more particularly a chamfer.

Said bevel can be provided with a decoration. This decoration can be formed by a separate decorative layer, which is provided on the bevel. This decorative layer can be formed by a lacquer, a print, more particularly a digital print, and the like. According to an alternative, the bevel may be formed by an impression in a top layer which is provided on the floor panel concerned.

The inventor has found that the mentioned height difference in particular can be applied in an advantageous manner with so-called soft, supple or flexible floor panels. To wit, it seems to be relatively difficult to manufacture such floor panels which have a constant thickness in mutual respect. In other words, there are thickness differences among such floor panels in mutual respect. As mentioned earlier, such thickness differences can be accommodated by means of such height difference.

More particularly, such height difference can be applied in an advantageous manner with floor panels which comprise a synthetic material-based substrate, such as floor panels of the LVT type ("Luxury Vinyl Tile"), VCT type ("Vinyl Composite Tile"), WPC type ("Wood Plastic Composite") or BPC type ("Bamboo Plastic Composite").

However, according to the invention it is not excluded that the aforementioned height difference can be applied with other types of floor panels, more particularly with hard floor panels, such as floor panels having a substrate of MDF or HDF.

It is also noted that the aforementioned height difference can also be applied in an advantageous manner with floor panels which can be coupled to each other by means of the so-called "fold-down" technique. In particular, this height difference can be applied in the proximity of the edges of the floor panels, which can be coupled by means of a downward movement in relative mutual respect. These edges preferably are situated on the short sides of the floor panels, in the case that these floor panels are oblong rectangular.

Figure 13:
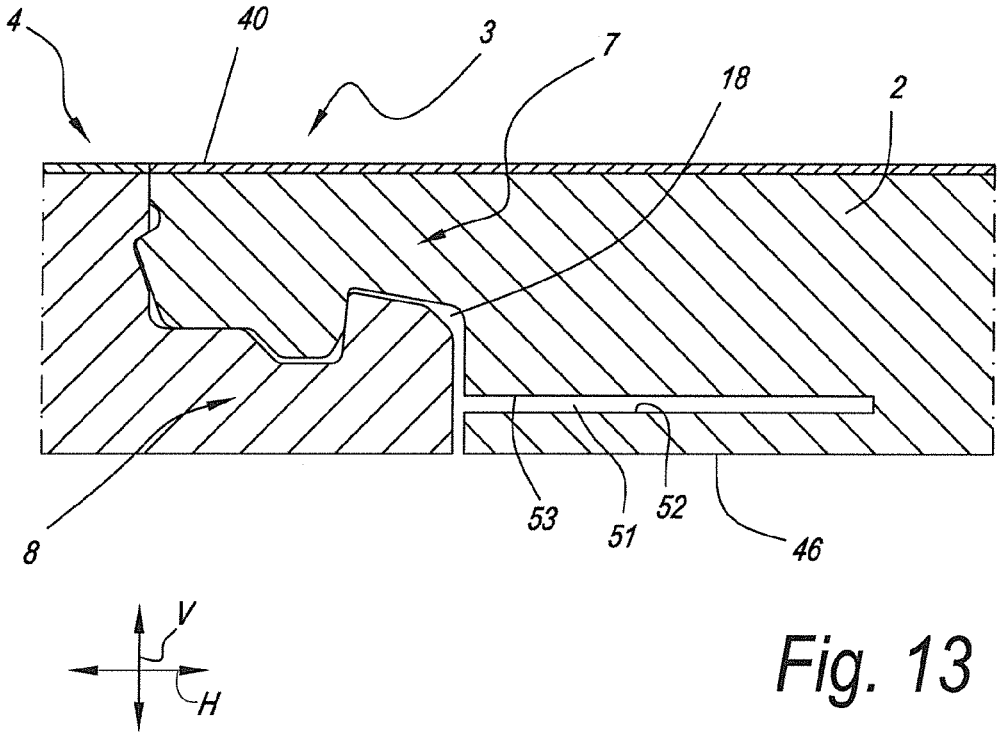
FIG. 13 represents a variant of FIG. 3.

In FIG. 13, another variant is represented of the embodiment represented in FIG. 3. The floor panel with the upper hook-shaped part 7 is provided with an incision 51. This incision 51 is situated at a distance from the lower side 46 of the floor panel.

Preferably, the incision 51 is situated closer to the lower side 46 of the floor panel than to the upper side 40. Still more preferably, the incision is situated at a distance from the lower side 46 of the floor panel, which is equal to or smaller than ¼ of the overall thickness of the floor panel.

The incision 51 can extend up to the downward-directed recess 18 and preferably adjoin thereto. More particularly, the incision 51 is open towards the recess 18.

The incision 51 comprises a lower side 52 and an upper side 53. These lower and upper sides 52-53 can be situated horizontally or, in other words, can be situated parallel to the plane of the floor panels. However, the lower and upper sides 52-53 can also be inclined. It is also noted that the orientation of the lower side 52 can differ from that of the upper side 53.

Preferably, the width of the incision 51 in vertical direction is smaller than 0.5 mm, more preferably smaller than 0.3 mm and still more preferably smaller than 0.2 mm. In particular, this width, seen over the entire incision 51, is uniform in horizontal direction.

The incision 51 can be formed of the material of the substrate 2. If the floor panel comprises a substrate 2 and a backing layer, the incision 51 preferably is formed in the substrate 2.

The depth of the incision 51 in horizontal direction can be adapted to the material characteristics of the floor panel in which the incision 51 is provided, and more particularly to the flexibility or softness of the floor panel. Preferably, the depth of the incision is increased the more the flexibility of the floor panel decreases.

The incision 51 provides for that the edge 3 can be pressed downward during coupling of the floor panels, such that a locking position among the floor panels can be achieved. Hereby, the advantage is obtained that the floor panels can be coupled in a particularly smooth manner. Such incision 51 can be advantageously applied in order to accommodate a thickness difference, as described herein above, among floor panels. To this aim, the width of the incision 51 can be adapted to the thickness difference among the floor panels. Preferably, this width is substantially equal to or larger than an average variation in thickness among the floor panels. More particularly, the width of the incision 51 can be substantially equal to or can be larger than a difference in thickness among the floor panels at their edges 3-4.

In particular, such incision 51 can be useful when it is applied with floor panels which are of the soft or flexible type, such as, for example, floor panels with a synthetic material-based substrate. More particularly, such incision 51 can be applied with floor panels of the LVT type, VCT type, WPC type or BPC type.

It is also noted that the application of such incision 51 as such forms an inventive idea. Thus, the present invention, according to a further independent aspect thereof, relates to a set of floor panels, wherein this set consists at least of a first floor panel and a second floor panel, wherein the first floor panel comprises a first edge which is provided with a male coupling part, and the second floor panel comprises a second edge, which is provided with a female coupling part, wherein these coupling parts allow that said floor panels can be coupled to each other at said edges by means of a downward movement of the first edge in relative respect to the second edge, and wherein said coupling parts, in the coupled condition of the floor panels, form a first locking system, which effects a locking in a first direction perpendicular to the plane of the floor panels, as well as form a second locking system, which effects a locking in a second direction perpendicular to the edges and in the plane of the floor panels, with the characteristic that an incision is formed in said first edge, wherein this incision is situated at a distance from a lower side of the floor panel. As such incision is provided, the advantage is obtained that the floor panels can be coupled particularly smoothly, even in the particular case that a thickness difference is present among the floor panels.

Preferred embodiments of the invention according to the last-mentioned independent aspect thereof can be formed, amongst others, by applying the characteristics of the incision, such as described herein above with reference to FIG. 13, to the set of floor panels according to this last-mentioned independent aspect.

It is also noted that this last-mentioned independent aspect can be combined at choice with one or more of the herein above-described characteristics of floor panels according to the invention.

In particular, this last-mentioned independent aspect can be applied in an advantageous manner with floor panels which are of the soft or flexible type, such as, for example, floor panels with a synthetic material-based substrate. More particularly, the last-mentioned independent aspect is applied with floor panels of the LVT type, the VCT type, the WPC type or the BPC type.

The present invention is in no way limited to the herein above-described embodiments; on the contrary, such floor panels can be realized according to various variants, without leaving the scope of the present invention.

The invention claimed is:

1. A floor panel comprising a substrate and coupling parts on a pair of opposite edges allowing to couple two of such floor panels to each other by means of a downward movement of one floor panel with respect to the other, wherein the coupling parts include a first locking system configured to effect a locking in a direction perpendicular to a plane of coupled floor panels and a second locking system configured to effect a locking in a direction perpendicular to coupled edges and in the plane of coupled floor panels;

wherein the coupling parts substantially are formed of a material of the substrate and are realized in one piece with the substrate;

wherein the second locking system includes a downward-directed upper hook-shaped part situated on one of the edges and an upward-directed lower hook-shaped part situated on the other edge, the hook-shaped parts being engageable behind each other by means of the downward movement;

wherein the upper hook-shaped part includes a lip with a downward-directed locking element and the lower hook-shaped part includes a lip with an upward-directed locking element;

wherein the first locking system comprises locking parts situated at a distal extremity of the upper hook-shaped part and at a proximal extremity of the edge comprising the lower hook-shaped part respectively;

wherein the lip of the lower hook-shaped part has an incision on a lower side of the lip extending inwardly from a distal extremity of the lower hook-shaped part, wherein the floor panel is configured such that in coupled condition of a first panel of such floor panels and a second panel of such floor panels at a pair of opposite edges a contact is formed between a distal side of the upward-directed locking element of the first panel and an edge of the coupled second floor panel.

2. The floor panel of claim 1, wherein said contact extends up to a certain distance from the lower side of the floor panel, such that a space is provided below said contact between the upward-directed locking element and the edge of the coupled panel.

3. The floor panel of claim 1, wherein the incision extends inwardly starting from the distal extremity of the lower hook-shaped part and at least up to a location where the locking elements cooperate with each other.

4. The floor panel of claim 1, wherein the lip of the upper hook-shaped part has an underside including a first surface and a second, more inwardly and lower situated second surface.

5. The floor panel of claim 1, wherein the upward-directed locking element has an upper side running inclinedly downward in a direction towards the distal extremity of the lower hook-shaped part.

6. The floor panel of claim 1, wherein the incision allows that the lip of the lower hook-shaped part is bendable downward to allow the edge of the second panel of such floor panels, during coupling of the floor panels, to be pressed downward until a locking position is achieved between the floor panels.

7. The floor panel of claim 1, wherein the incision has an upper side that is situated substantially parallel to the plane of coupled floor panels.

8. The floor panel of claim 1, wherein the floor panel is configured such that in coupled condition of two such floor panels at their pair of opposite edges, no locking in the direction perpendicular to the plane of the coupled floor panels is provided at the contact between the proximal end of the upward-directed locking element and the proximal end of the downward-directed locking element.

* * * * *